US006995525B2

(12) United States Patent
Barthelmess

(10) Patent No.: US 6,995,525 B2
(45) Date of Patent: Feb. 7, 2006

(54) LIGHT DISPLAY WITH COLOR AND CLEAR LIGHTS

(76) Inventor: Peter W. Barthelmess, c/o Barthelmess, 8550-B Chetle Ave., Whittier, CA (US) 90606

( * ) Notice: Subject to any disclaimer, the term of this patent is extended or adjusted under 35 U.S.C. 154(b) by 41 days.

(21) Appl. No.: 10/705,968

(22) Filed: Nov. 13, 2003

(65) Prior Publication Data

US 2005/0104533 A1 May 19, 2005

(51) Int. Cl.
*H05B 37/00* (2006.01)

(52) U.S. Cl. ..... 315/323; 315/316; 315/312; 315/152; 362/800; 362/806

(58) Field of Classification Search ..... 315/152–154, 315/149, 185 S, 200 A, 312–314, 320; 362/11, 362/800–808

See application file for complete search history.

(56) References Cited

U.S. PATENT DOCUMENTS 4,215,277 A * 7/1980 Weiner et al. ..... 307/41
5,629,587 A * 5/1997 Gray et al. ..... 315/292
6,424,096 B1 7/2002 Lowe et al. ..... 315/185 R
2002/0154787 A1 * 10/2002 Rice et al. ..... 381/124
2004/0075401 A1 * 4/2004 Segan et al. ..... 315/291
2004/0150984 A1 * 8/2004 Robertson et al. ..... 362/95
2004/0184354 A1 * 9/2004 McDonald ..... 368/3
2005/0013139 A1 * 1/2005 Sugihara et al. ..... 362/490

OTHER PUBLICATIONS

Ad entitled "Remote Controlled 5-Color Light Changer Pre-Lit Permanent Tree".
"Light Changer", Barthelmess Product Brochure, Jan. 5, 2003.

* cited by examiner

*Primary Examiner*—Tuyet Thi Vo
(74) *Attorney, Agent, or Firm*—McDermott Will & Emery, LLP

(57) ABSTRACT

A light display power box receives a string of clear and a string of colored lights thereby displaying clear and colored lights simultaneously to form selected light display patterns. The light display power box includes a plurality of outlets for receiving at least one string of clear lights and at least one string of colored lights. Additionally, the light display power box includes electronic circuitry including a microprocessor programmed to receive, process, and use received command signals to program selected light patterns. In one embodiment, a remote control transmitter transmits wireless command signals associated with selected light patterns to a sensor unit housed within or in proximity to the light display power box.

15 Claims, 4 Drawing Sheets

LIGHT DISPLAY WITH COLOR AND CLEAR LIGHTS

FIELD OF THE INVENTION

This invention relates to light displays having a plurality of light strings. More specifically, the invention relates to a remote-controlled light display having both clear light strings and colored light strings.

BACKGROUND OF THE INVENTION

Light display mechanisms typically possess a plurality of light strings and most often are used for decorative purposes, such as for holiday and festival ornamentation. The lights in such light strings are generally positioned in series and made up of lights that are all the same color or different colors. Additionally, a given light string may be of a color different than the color of other light strings in the light display. The lights in the light display may also exhibit different patterns of display. For example, the brightness of the lights may be adjusted, the lights may be set to blink on and off, and/or the lights may fade or move from an on position to an off position in a manner so that they appear to be moving or traveling along a path.

The light displays known in the art include AC-powered displays that have an integrated control unit and control panel to control the lighting pattern of various colored light strings included in the light display. Additionally, the known art includes light displays having colored light strings which are controllable by a hand-held, remote controller such as that described in U.S. Pat. No. 6,424,096 ("'096") to Lowe, et al. The light display of the '096 patent, as well as other known art, is limited in that the display only provides for a display of colored lights.

Accordingly, there exists a need in the art for a light display that is capable of displaying at least one string of clear lights and at least one string of colored lights. There is a further need in the art for the display features of the clear light strings and the colored light strings in the light display to be controlled from a location remote to the light display.

SUMMARY OF THE INVENTION

In one embodiment, the present invention provides a light display power box having a plurality of outlets which are adapted to receive at least one string of clear lights and at least one string of colored lights; a sensor unit to receive command signals; electronic circuitry including a microprocessor which is programmed to receive, process, and use the command signals to cause the string of colored lights and the string of clear lights to illuminate according to a selected light display pattern; and a power plug to connect to a power source for providing power to the light display power box.

In another embodiment, the invention provides a light display power box having six outlets, where three of the outlets are adapted to receive at least one string of clear lights, and three of the outlets are adapted to receive at least one string of colored lights, where at least one of the string of colored lights includes lights of at least two different colors; a sensor unit adapted to receive command signals; electronic circuitry including a microprocessor which is programmed to receive, process, and use the command signals to cause the string of colored lights and the string of clear lights to illuminate according to a selected light display pattern; and a power plug to connect to a power source for providing power to the light display power box.

In yet another embodiment, the present invention includes a light display system having a plurality of outlets which are adapted to receive a string of clear lights and a string of colored lights; a remote control transmitter for generating wireless command signals; a sensor unit to receive the wireless command signals; electronic circuitry including a microprocessor which is programmed to receive, process, and use the wireless command signals to cause the string of colored lights and the string of clear lights to illuminate according to a selected light display pattern; and a power plug to connect to an AC power source in order to provide power to the light display system.

In yet another embodiment, the present invention provides a method of displaying clear lights and colored lights including the steps of: providing power to a light display power box having a series of outlets for receiving at least one string of clear lights and at least one string of colored lights; selecting command signals on a transmitter which correspond to a light display pattern to be displayed by at least one string of clear lights and at least one string of colored lights; sending the command signals from the transmitter to a sensor unit which is electrically coupled to the light display power box; receiving, processing, and using the command signals through a microprocessor housed within the light display power box, thereby displaying selected light display patterns that correspond to the command signals.

In yet another embodiment, the present invention includes a method of displaying clear lights and colored lights having the steps of: providing power to a light display power box having a series of outlets for receiving at least one string of clear lights and at least one string of colored lights; selecting wireless command signals on a remote control transmitter which correspond to a display pattern to be displayed by the at least one string of clear lights and the at least one string of colored lights; sending the wireless command signals from the remote control transmitter to a sensor unit electrically coupled to the light display power box; receiving, processing, and using the wireless command signals through a microprocessor housed within the light display power box, thereby displaying selected light display patterns that correspond to the wireless command signals. The objects, features and advantages of the present invention will be apparent from the following detailed descriptions of the invention in conjunction with reference to the following drawings.

DETAILED DESCRIPTION OF THE PREFERRED EMBODIMENT

Figure 1:
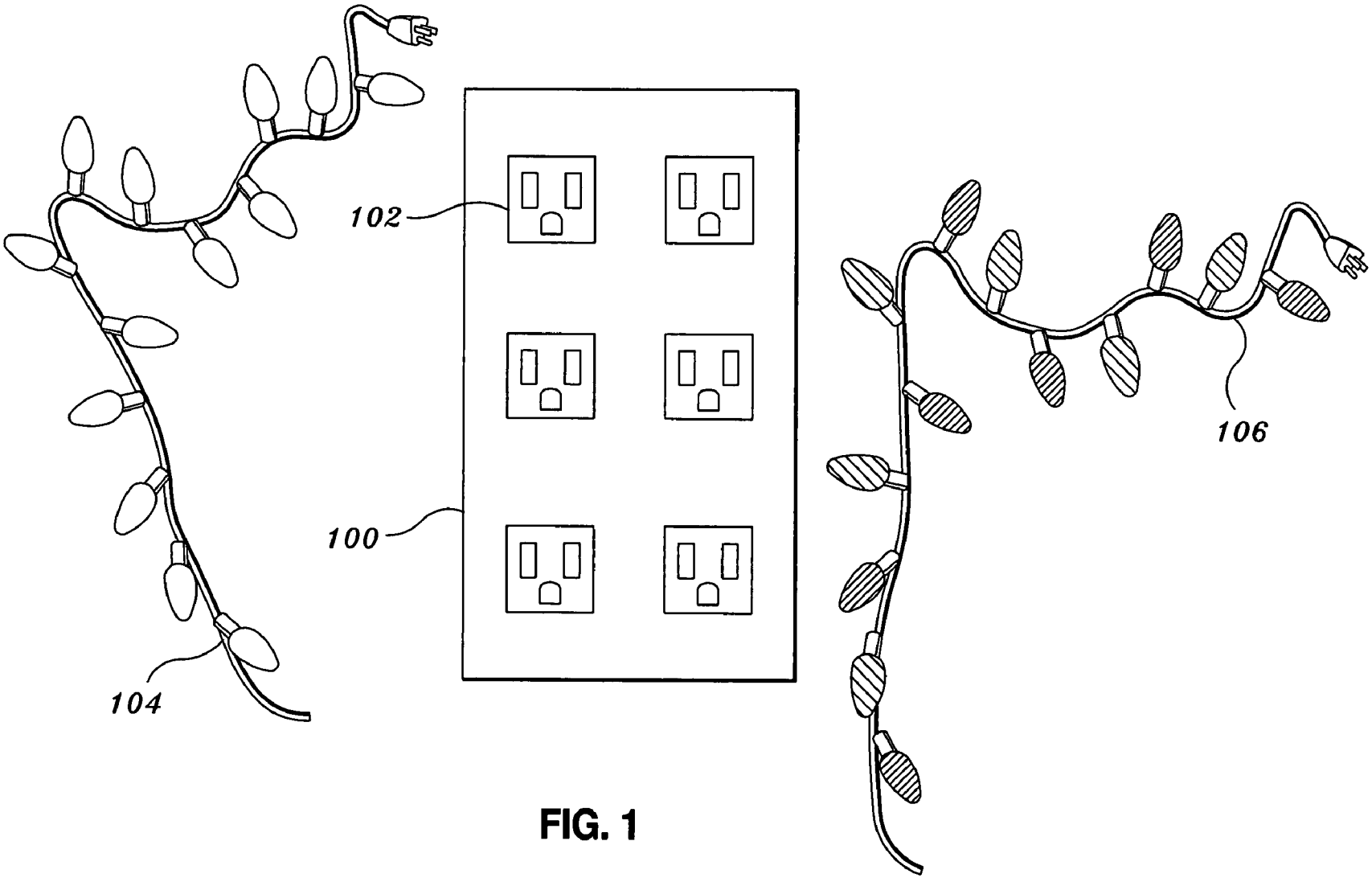
FIG. 1 is a top elevational view of one aspect of the light display power box of the present invention.

FIG. 1 presents a top elevational view of the light display power box 100 depicting the plurality of outlets 102. As shown, in one aspect of the invention, the light display power box 100 has six outlets 102, although one in the art would appreciate that any number of a plurality of outlets 102 could be included in the present invention. At least one of the outlets 102 in the light display power box 100 is able to receive at least one string of clear lights 104, while at least one of the outlets 102 is able to receive at least one string of colored lights 106. It is also provided that multiple strings of the same colored lights may be plugged into the same outlet 102. The string of clear lights 104 and the string of colored lights 106, in a preferred embodiment, are of the type commonly known in the art where the lights in the respective strings are electronically configured in series. In one aspect of the invention, at least one of the plurality of outlets 102 may receive at least one of a plurality of colored light strings different in color than at least one other of the plurality strings of colored lights 106 received by another of the plurality of outlets 102 in the light display power box 100. A non-limiting example of such would be where one outlet 102 in the light display power box 100 is adapted to receive blue light strings while another outlet 102 in the light display power box 100 is adapted to receive red light strings. Additionally, in a preferred embodiment, the light display power box 100 includes six outlets 102 where three outlets 102 are adapted to receive at least one string of clear lights 104 and three outlets 102 are adapted to receive at least one string of colored lights 106. Each string of colored lights 106 may include lights of at least two colors or more. In one embodiment, the three outlets adapted to receive at least one string of clear lights 104 are color coded by a first color and the three outlets adapted to receive at least one string of colored lights 106 are colored coded by color different from the first color. It would be appreciated in the art that such multi-colored light strings are those which include at least two different colors of lights in the same string. It would also be appreciated by one skilled in the art that any number of outlets 102 may be provided to receive at least one string of clear lights 104 and at least one string of colored lights 106.

Notably, in a preferred embodiment of the invention, at least one string of clear lights 104 and at least one string of colored lights 106 are connected to the outlets 102 in the light display power box 100 at the same time. It is however possible that only at least one string of clear lights 104 or at least one string of colored lights 106 is connected to the light display power box 100 at any given time. One skilled in the art will appreciate that any color, combination and/or number of light stings could be used in addition to or instead of the aforementioned.

In another embodiment, at least one of the plurality of outlets 102 may be color coded corresponding to the color of the light string the outlet 102 is adapted to receive. For example, an outlet 102 adapted to receive a string of red lights may be colored red, while an outlet 102 adapted to receive a string of green lights may be colored green. It is additionally provided that an outlet 102 adapted to receive a string of clear lights 104 may be white or without color. In a further embodiment, those outlets 102 adapted to receive colored lights may be without color, or the same color as the light display power box 100, while the outlets 102 adapted to receive a string of clear lights may be white, clear, or another color designating the outlet(s) 102 as adaptable to receiving a string of clear lights 104. One skilled in the art would recognize that a wide range of colors and configurations may be used to differentiate the outlet(s) 102 adapted to receive a string of clear lights 104 as opposed to those adapted to receive a string of colored lights 104.

Figure 2:
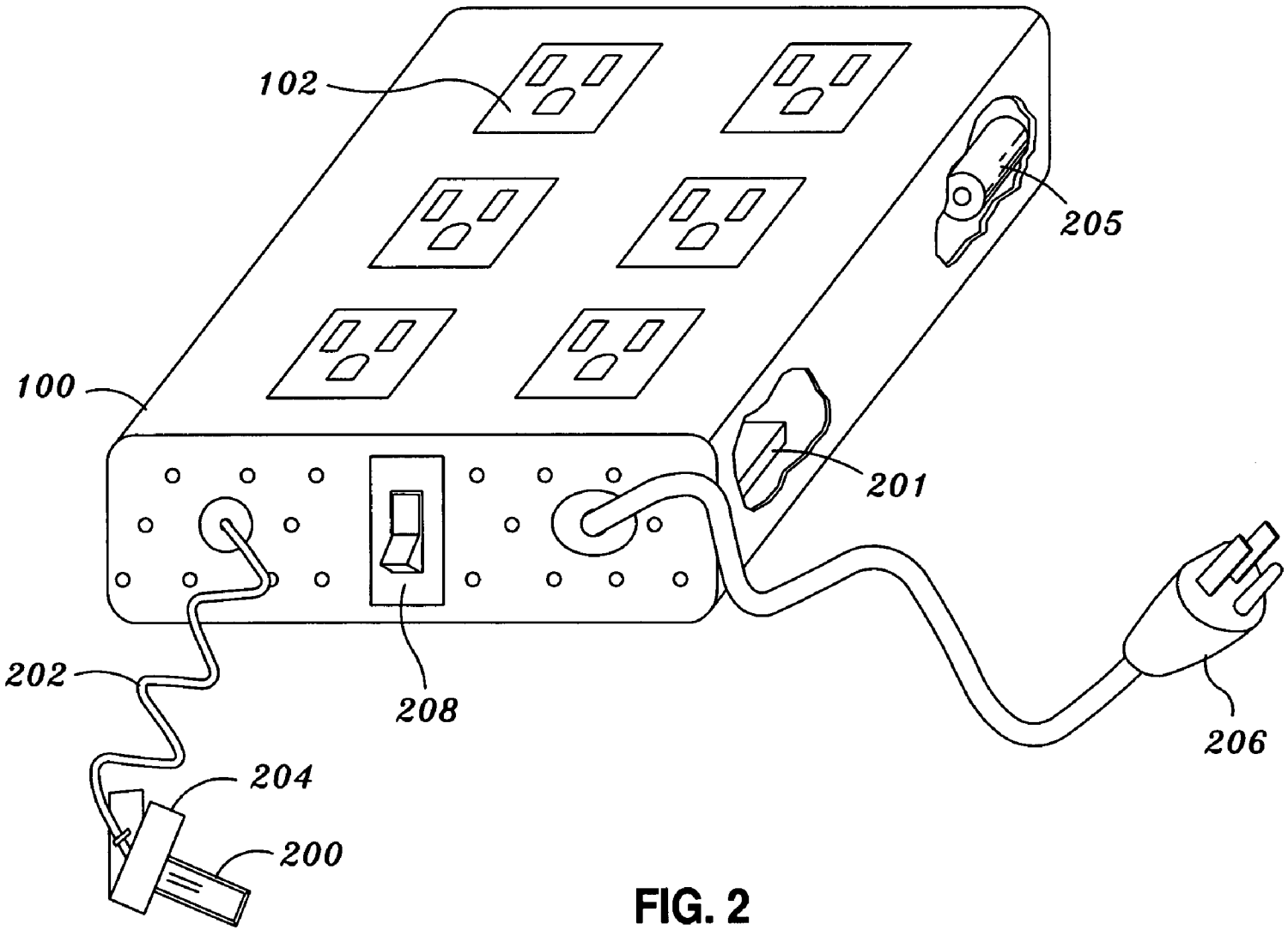
FIG. 2 is a side perspective view of the light display power box of the present invention including a view of a sensor unit, a on/off switch and a power plug attached thereto.

FIG. 2 is a side perspective view of the light display power box 100 depicted in FIG. 1. In one aspect, wireless command signals are sensed by a sensor unit 200 which is attached to the light display power box 100. In a preferred aspect, the sensor unit 200 is an infrared sensor unit 200 capable of receiving infrared wireless command signals from a remote control transmitter 300 (see FIGS. 3*a* and 3*b*). Alternatively, the sensor unit 200 may be adapted to receive radio frequency signals. The sensor unit 200, in an additional aspect of the invention, may be directly attached to the light display power box 100 or attached to the light display power box 100 by a length of wiring 202. A further aspect provides an attachment apparatus 204, such as but not limited to, a loop, a clip, a fastener, a hook or a tie. The attachment apparatus 204 may be affixed to the sensor unit 200 or to the length of wiring 202 in proximity to the sensor unit 200 so that the sensor unit may be positioned or attached at a desired location. This latter embodiment is of particular use when convenient access to the sensor unit 200 and control of the light display is needed, such as when the light display is being used to decorate a Christmas tree or other object.

In one embodiment of the present invention, the sensor unit 200 communicates the wireless command signals it receives to microprocessor 201 housed within the light display power box 100. Microprocessor 201, along with other electronic circuitry in the light display power box 100, receives, processes and uses the wireless command signals to effectuate a selected light display pattern to be displayed by the at least one string of clear lights 104 and the at least one string of colored lights 106 connected to the outlets 102 on the light display power box 100.

In one aspect of the invention, a power plug 206 may be adapted to a power source to provide power to the light display power box 100. In a further aspect, the power plug 206 is an AC power plug that provides AC power to the light display power box 100 from an AC receptacle power source. In another embodiment, DC power source 205 (illustrated as a battery) is used to power the light display power box 100. In one aspect of the invention, the light display power box 100 also includes an on/off switch 208. This on/off switch 208 allows the light display power box 100 to switch from a state where the light display power box 100 receives power to a state where the light display power box 100 is turned off.

In an alternative aspect of the invention, the light display power box 100 includes a transmitter that may be coupled to or integrated with the light display power box 100. The transmitter may include a series of control buttons or a type of selection keys commonly used in the art to allow for the selection of command signals that correspond to the light display patterns displayed by the at least one string of clear lights 104 and the at least one string of colored lights 106 received by the outlets 102 in the light display power box 100.

Figure 3B:
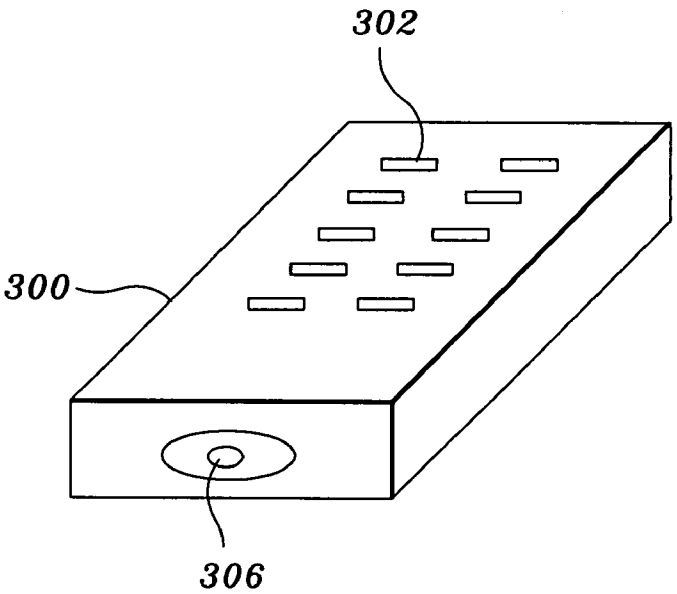
FIG. 3*a* is a top elevational view of the remote control transmitter of the present invention, while FIG. 3*b* provides a side perspective view of the remote control transmitter of the present invention displaying the window on the remote control transmitter through which wireless command signals pass.
Figure 3A:
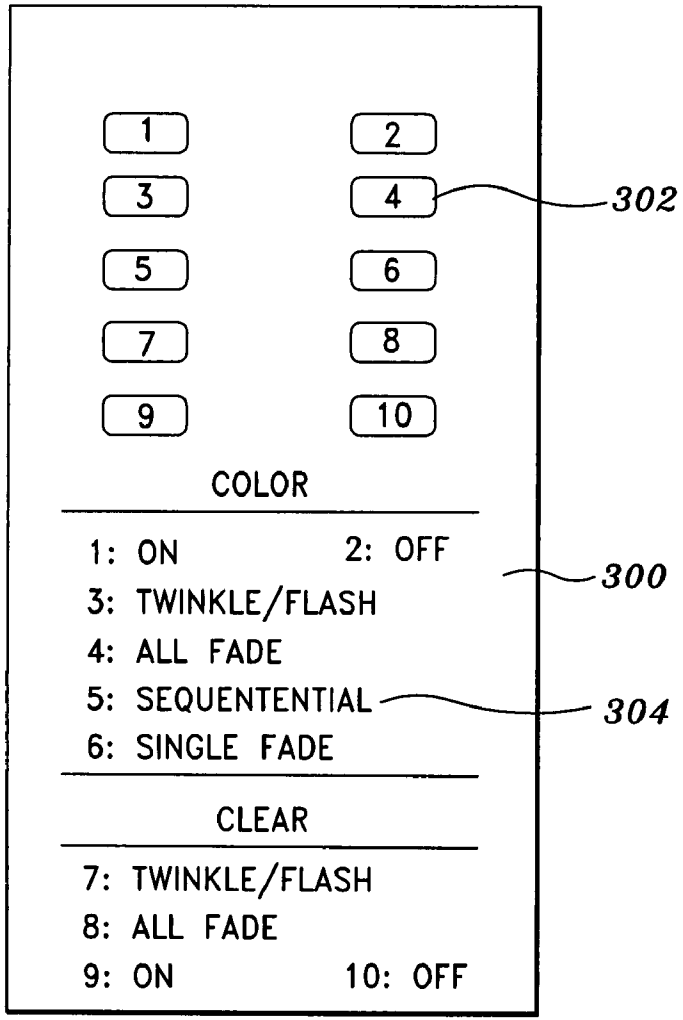

FIGS. 3*a* and 3*b* depict the remote control transmitter 300 of the present invention. In FIG. 3*a,* a top elevational view of the remote control transmitter is presented. A plurality of control buttons 302 and corresponding explanatory notations 304 may be present on the surface of the remote control transmitter 300. The plurality of control buttons 302 along with the corresponding explanatory notations 304 allow for the selection of specific wireless command signals to control the light display patterns presented by the at least one string of clear lights 104 and the at least one string of colored lights 106 connected to the light display power box 100. These control buttons 302, in addition to controlling the light patterns, may also control the on/off state of the light display power box 100. As noted, one skilled in the art would recognize that the control buttons 302 could be any type of selection keys or strokes recognized in the art. Additionally, the specific explanatory notations 304 shown in FIG. 3*a* are for illustrative purposes, and one skilled in the art would recognize that those depicted are a small sampling of possible explanatory notations 304 and are not meant to be limiting.

As noted, the remote control transmitter 300 allows for the selection of specific wireless command signals corresponding to the light display patterns to be displayed by the string of clear lights 104 and the string of string of colored lights 106 accommodated by the light display power box 100. It is also possible that, based on a user's selection, wireless command signals correspond to the light display patterns of only the string of clear lights 104 or only the string of colored lights 106.

FIG. 3*b* is a side perspective view of the remote control transmitter 300. The remote control transmitter 300, as shown by the embodiment presented, includes a window 306 through which the command signals pass to the sensor unit 200. In this aspect, the command signals are wireless command signals. For example, the remote control transmitter 300 may transmit a radio frequency and the sensor unit 200 may be adapted to receive the radio frequency, such as a radio frequency of a range of approximately 200 to 400 Mhz. The microprocessor in the light display power box 100 then receives, processes and uses the wireless command signals to activate the light display patterns selected by the user.

The light display patterns capable of being processed and displayed by the present invention are of a wide variety. For example, various embodiments of the present invention include, but are not limited to, light display patterns that: alter the brightness of at least one of the string of clear lights 104 and the string of colored lights 106; fade the brightness of at least one of the string of clear lights 104 and the string of colored lights 106; blink at least one of the string of clear lights 104 and the string of colored light 106; change at least one of the string of clear lights 104 and the string of colored lights 106 from a lighted state to a dark state at random intervals thereby producing a random pattern of illumination; change at least one of the string of clear lights 104 and the string of colored lights 106 from a lighted state to a dark state at sequential intervals thereby producing a traveling affect light pattern. The present invention also provides for embodiments in which at least two, at least three, or all of the aforementioned light display patterns are displayed simultaneously.

Figure 4:
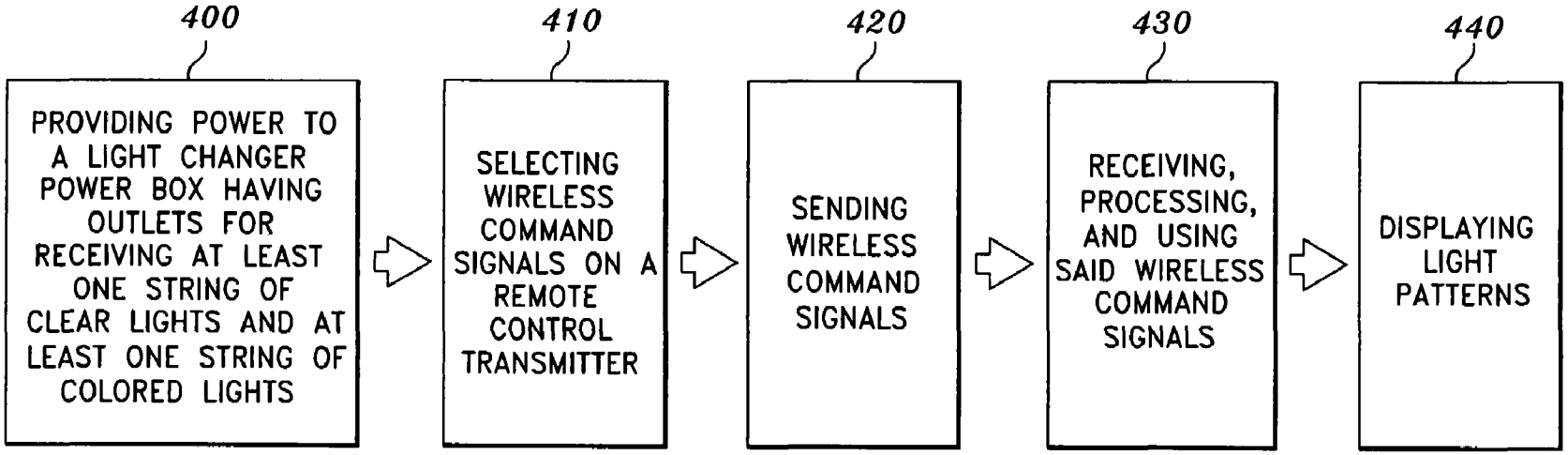
FIG. 4 is a process flow diagram of a method for displaying lights clear and colored lights in a light display.

FIG. 4 is a process flow diagram of a method of displaying clear and colored lights through a light display power box 100. As shown in step 400, power is provided to a light display power box 100 having a series of outlets 102 for receiving at least one string of clear lights 104 and at least one string of colored lights 106. In step 410, wireless command signals on a remote control transmitter 300 are selected where the wireless command signals correspond to light display patterns to be displayed by at least one string of clear lights 104 and at least one string of colored lights 106. Next, step 420 provides for sending the wireless command signals from the remote control transmitter 300 to the sensor unit 200 which is coupled to the light display power box 100. A step of receiving, processing, and using the wireless command signals through the microprocessor which is housed within the light display power box 100 and programmed to process the wireless command signals received by the sensor unit 200 is included in step 430. In step 440, light display patterns corresponding to the wireless command signals on at least one string of clear lights 104 and at least one string of colored lights 106 connected to the light display power box 100 are activated.

In an additional embodiment, the method of displaying clear lights and colored lights may include a step of connecting at least one of string of colored lights 106 which is different in color from at least one other string of colored lights 106 connected to an outlet 102 in the light display power box 102. A step of receiving at least one of string of colored lights 106 having lights of at least two different colors in the string of colored lights 106 is also provided. Another embodiment of the present invention includes a step of altering the brightness of at least one of the string of clear lights 104 and the string of colored lights 106. In an even further embodiment, the step of altering the brightness includes an additional step of fading the brightness of at least one of the string of clear lights 104 and the string of colored lights 106 from light to dark.

Additional, non-limiting aspects of the method of displaying clear lights and colored lights may include further steps. For example, a step of choosing wireless command signals to cause at least one of the string of clear lights 104 and at least one of the string of colored lights 106 to blink may be included. Furthermore, the method may provide a step of choosing wireless command signals to cause a random pattern of illumination by causing at least one of the string of clear lights 104 and at least one of the string of colored lights 106 to change from a lighted state to a dark state at random intervals. Additionally, a step of choosing wireless command signals to cause a traveling affect light pattern by causing at least one of the string of clear lights 104 and at least one of the string of colored lights 106 to change from a lighted state to a dark state at sequential intervals may be included. Also provided are further steps of activating at least two, activating at least three, or activating all of the following light display patterns: altering the brightness of at least one of the string of clear lights 104 and at least one of the string of colored lights 106; blinking at least one of said string of clear lights 102 and at least one of said string of colored lights 106; providing a random pattern of illumination by causing at least one of the string of clear lights 104 and at least one of the string of colored lights 106 to change from a lighted state to a dark state at random intervals; and providing a traveling affect light pattern by causing at least one of the string of clear light 104 and at least one of the string of colored lights 106 to change from a lighted state to a dark state at sequential intervals.

While the present invention had been described in terms of the preferred embodiments, other variations which are within the scope of the invention as defined in the claims will be apparent to those skilled in the art.

What is claimed is:

1. A light display power box, comprising:

first and second outlets, said first outlet receiving at least one of a first type of lights, said second outlet receiving at least one of a second type of lights, wherein said first and second outlets are coded corresponding to light type;

a microprocessor, said microprocessor effectuating a selected light display pattern for the first type of lights and the second type of lights, either together or separately, based upon command signals; and a sensor unit further comprising an attachment apparatus, said sensor unit affixed to the light display power box via a length of wire and positioned to remotely receive wireless command signals.

2. A light display power box according to claim 1, wherein said first and second outlets are color coded.

3. The light display power box according to claim 1, further comprising:

a transmitter, said transmitter further comprising a plurality of control buttons for selecting the command signals for transmission to said sensor unit, the command signals selectively establishing defined light display patterns for said first type of lights and said second type of lights.

4. The light display power box according to claim 1, wherein said first type of lights are clear lights, and said second type of lights are colored lights.

5. The light display power box according to claim 1, wherein the second type of lights are multi-colored lights.

6. The light display power box according to claim 1, wherein the second type of lights are red, blue and/or green lights.

7. The light display power box according to claim 1, wherein the command signals cause said first type of lights and/or said second type of lights to blink.

8. The light display power box according to claim 1, wherein the command signals cause said first type of lights and/or said second type of lights to change from a lighted state to a dark state at random intervals thereby producing a random pattern of illumination.

9. The light display power box according to claim 1, wherein the command signals cause said first type of lights and/or said second type of lights to change from a lighted state to a dark state at sequential intervals thereby producing a traveling affect light pattern.

10. The light display power box according to claim 1, wherein said sensor unit is an infrared sensor unit.

11. The light display power box according to claim 1, wherein said sensor unit is a radio frequency sensor unit.

12. The light display power box according to claim 1, further comprising a third outlet, said third outlet receiving at least one of said first type of lights or said second type of lights.

13. The light display power box according to claim 12, further comprising fourth through sixth outlets, said fourth through sixth outlets receiving at least one of said first type of lights and/or said second type of lights.

14. A light display power box system, comprising:

a holiday decoration; and a light display power box, further comprising:

first and second outlets, said first outlet receiving at least one of a first type of lights, said second outlet receiving at least one of a second type of lights, wherein said first and second outlets are coded corresponding to light type;

a microprocessor, said microprocessor effectuating a selected light display pattern for the first type of lights and the second type of lights, either together or separately, based upon command signals; and a sensor unit further comprising an attachment apparatus, said sensor unit affixed to the light display power box via a length of wire and positioned on said holiday decoration to remotely receive wireless command signals.

15. The light display power box system according to claim 14, wherein the holiday decoration is a Christmas tree.

* * * * *